US005819951A

United States Patent [19]

Sultanovich et al.

[11] Patent Number: 5,819,951

[45] Date of Patent: Oct. 13, 1998

[54] SEPARATOR PLATE FOR THE SCREENING OF A PARTICULATE MATERIAL AND A SORTING APPARATUS COMPRISING SAME

[75] Inventors: Efim Sultanovich, Kiryat Yam; Victor Grozubinsky, Karmiel, both of Israel

[73] Assignee: A.S.T. Advanced Screening Technologies LTD., Kiryat Shmona, Israel

[21] Appl. No.: 739,515

[22] Filed: Oct. 29, 1996

[51] Int. Cl.[6] ..... B07B 1/28

[52] U.S. Cl. ..... 209/313; 209/353; 209/397

[58] Field of Search ..... 209/397, 353, 209/325, 320, 313, 311, 680

[56] References Cited

U.S. PATENT DOCUMENTS

| | | | |
|---|---|---|---|
| 1,561,632 | 11/1925 | Woodward . | |
| 3,420,658 | 1/1969 | Reding, Jr. et al. | 209/397 X |
| 5,211,291 | 5/1993 | Kelley . | |
| 5,586,661 | 12/1996 | Maki | 209/397 |
| 5,699,918 | 12/1997 | Dunn | 209/397 |

FOREIGN PATENT DOCUMENTS

| | | |
|---|---|---|
| 1282608 A | 6/1962 | France . |
| 45 982 C | 4/1889 | Germany . |
| 6606721 A | 1/1967 | Netherlands . |
| 2052310 | 1/1981 | United Kingdom . |

*Primary Examiner*—David H. Bollinger
*Attorney, Agent, or Firm*—Browdy and Neimark

[57] ABSTRACT

The invention provides a separator plate for the screening of particulate material comprising an upstream non-perforated segment, and at least one downstream screening segment with orifices of a desired size and orientation and with a plurality of upward protruding pins distributed between the orifices. There is also provided a sorting apparatus comprising a vibratory screen constituting the above-described separator plate.

16 Claims, 4 Drawing Sheets

SEPARATOR PLATE FOR THE SCREENING OF A PARTICULATE MATERIAL AND A SORTING APPARATUS COMPRISING SAME

FIELD OF THE INVENTION

The present invention is in the field of sorting bulk particulate materials by screening, and relates to a sorting apparatus of the kind that comprises a vibratory screen. The invention concerns in particular a separator plate for use as vibratory screen in such an apparatus.

BACKGROUND OF THE INVENTION

In many branches of industry and agriculture particulate bulk material such as ores, aggregates for use in the building industry, seeds, wood chips etc. are sorted by screening in order to classify them by size or shape. It is known to divide the vibratory screens or separator plates of such devices into sections with orifices of different size or shape such that as the bulk material moves on the horizontal vibratory screen (or glides along the slanted vibratory screen) the orifices in each section allow the passage of particles of a certain size or shape whereby the particles are classified in a desired way. For the sorting of elongated particles, screens with rectangular slots or oval orifices may be used.

It has always been the object of designers in the field to reduce as far as possible the working area of the screen and the duration of the screening operation but attainment of these goals has been problematic.

When a particulate bulk material with random distribution of particles of different sizes is poured on to a vibratory screen, the mass separates essentially into two Layers of which the upper one holds the relatively large particles which have a relatively low density while the lower one holds the smaller particles with the relatively higher density. Usually, flowing of the mass from an upstream portion of the vibratory screen towards its downstream portion is achieved either by suitably directed vibrations of the screen or by the slanted positioning thereof. It was to be expected that upon the above-mentioned stratification the smaller particles of the lower layer should all first pass across an upstream portion of the screen to be followed by the passage of the larger particles across a downstream portion thereof. It has, however, been shown that this expectation is not fulfilled and that in practice a significant proportion of the small-size particles glides over the screen and reaches the downstream portion thereof with the consequence that the sorting is ineffective. Furthermore, in the case of screens with orifices in the form of slots for the sorting of elongated particles such as seeds, wood chips etc., the random movement of such particles on the screen surface during its vibration leads to a random orientation of the particles with respect to the longitudinal axes of the slots. Consequently, many of the elongated particles are not aligned with the appropriate slots and will thus glide over these slots without falling therethrough. This, then, is a further contributory factor to the ineffectiveness of known sorting devices of the kind specified.

Theoretically one could at least partly overcome these shortcomings by making the sorter plates or screens and each section thereof longer but the resulting dimensions and operating times might thus become prohibitive.

U.S. Pat. No. 5,211,291 describes a separator plate construction for flake-like members, such as wooden or metal chips It is provided with elongated slot openings and longitudinal orienters on the plate body for partially lifting and turning elongated flake-like members so that they can pass through the slots by their longer and thinner side. A disadvantage of that design is that its use is restricted to specific, flake-like materials. Moreover, for proper operation of the device, bulk material must be fed on to the plate in a single layer flow. Still further, the orienters are rather bulky and occupy a considerable part of the working area of the separator plate.

SUMMARY OF THE INVENTION

It is a first object of the present invention to provide a new separator plate to serve as screen in an apparatus for the sorting of particulate material of the kind that has a vibratory separator screen. It is a further object of the present invention to provide a sorting apparatus of the kind specified comprising the said new separator plate.

In the following description and claims the terms "upstream" and "downstream" when used in relation to a separator plate or parts thereof, signify, respectively, the direction towards the zone at which, in operation, the bulk material is poured on to the plate, and the opposite direction; and the term "transversal" where used in relation to a separator plate signifies a direction essentially normal to the direction of flow of bulk material thereon.

In accordance with the present invention there is provided a separator plate for the screening of particulate material comprising an upstream non-perforated segment, and at least one downstream screening segment with orifices of a desired size and orientation and with a plurality of upward protruding pins distributed between the orifices.

In operation the particulate material to be sorted flows along the vibrating separator plate. During vibration the upstream, non-perforated segment of the separator plate serves for preliminary stratification of the flowing particulate material.

According to one embodiment of the invention, the upstream, non-perforated segment has transversely extending corrugations whereby the preliminary stratification of the flowing particulate material is enhanced. Alternatively, the upstream non-perforated segment may have an essentially smooth upper surface.

The pins of the downstream screening segment have the effect that by transmitting the vibratory movement to the flowing particulate material they restore the stratification at this particular segment. Furthermore, the pins constitute physical obstacles whereby the flow velocity of the particles is reduced and the time of separation is increased. Finally the pins are also instrumental in aligning oblong particles with the direction of flow. As a result of all this the particle separation at the downstream segment is enhanced.

The invention further provides a sorting apparatus fitted with a vibratory separator plate of the kind specified, either horizontal or slanting.

Where the separator plate according to the invention comprises more than one downstream screening segment, the segment distal of the upstream non-perforated segment will comprise the said upward protruding pins. Any further, intermediary downstream screening segment may or may not comprise such pins.

The separator plate according to the invention may be a single integral body. Alternatively each of the upstream and downstream segments may be a separate unit with segmented units being suitably connected to each other in a rigid fashion.

According to one embodiment of the invention the separator plate comprises first and second downstream screening segments with the orifices in each of these segments differing from each other by any of their size, shape and orientation.

In accordance with the invention the process of stratification of the bulk material into layers holding particles of different specific densities and size and the process of screening occur sequentially. Thus, in operation the bulk material to be sorted is poured into the upstream, non-perforated and preferably corrugated segment where it is only stratified into layers of different densities without, however, any screening taking place, and subsequently screening occurs in any of the downstream segments. It was shown that in accordance with the invention the screening operation is rendered significantly more effective than in prior art devices without undue increase of the surface area of the screen and the duration of the screening operation.

In a preferred embodiment of the invention, said upstream corrugated segment comprises a plurality of transversal ribs each having a relatively gently sloping upstream side and a steep downstream side. In accordance with this embodiment the width of a notional base extending between two lower edges of a rib is approximately one and a half to twice the height of the rib. Where in this embodiment the orifices of the adjacent screening segment are circular the height of a rib may be between 8 to 15 diameters of an orifice.

If desired, the upstream non-perforated segment (whether corrugated, smooth or having another upper surface profile) may be fitted with a plurality of upwards projecting spikes, whereby stratification of the bulk material is enhanced, and clods (if any) of the material are comminuted.

In accordance with the preferred embodiment of the invention the upstream side of each of the ribs is fitted with said upwards projecting spikes. Preferably the upper ends of these spikes are coplanar with the ridges of the transversal ribs.

Both the pins of the downstream screening segment or segments and the spikes projecting from the upstream non-perforated segment may have any suitable shape such as cylindrical, frusto-conical, prismatic, etc.

As mentioned, the orifices of the first, second and any further downstream screening segment may differ from each other by size, orientation, or both. Thus, in two successive screening segments the orifices may have the same size and differ from each other by orientation only. For example, if the bulk material comprises a lot of elongated particles which are to be retained on a screening segment, the orifices may be in form of rectangular transversal slots whereby the elongated particles are retained even if by virtue of their size alone they would be capable of passing across the slots. Where, on the other hand, elongated particles are to be sorted by their size, the slots will be essentially coaxial with the direction of flow of the bulk material and in successive screening segments the size of the slots increases in downstream direction.

Depending on the nature of the bulk material and the desired particle classification, it is possible to combine the above two effects in that in a first screening segment the slots extend essentially transversely while in a subsequent screening segment the slots are turned by 90° with their longitudinal axes essentially parallel to the direction of flow.

BRIEF DESCRIPTION OF THE DRAWINGS

Some specific embodiments of the invention will now be described, by way of example only with reference to the annexed drawings wherein.

DETAILED DESCRIPTION OF SOME PREFERRED EMBODIMENTS

Figure 1:
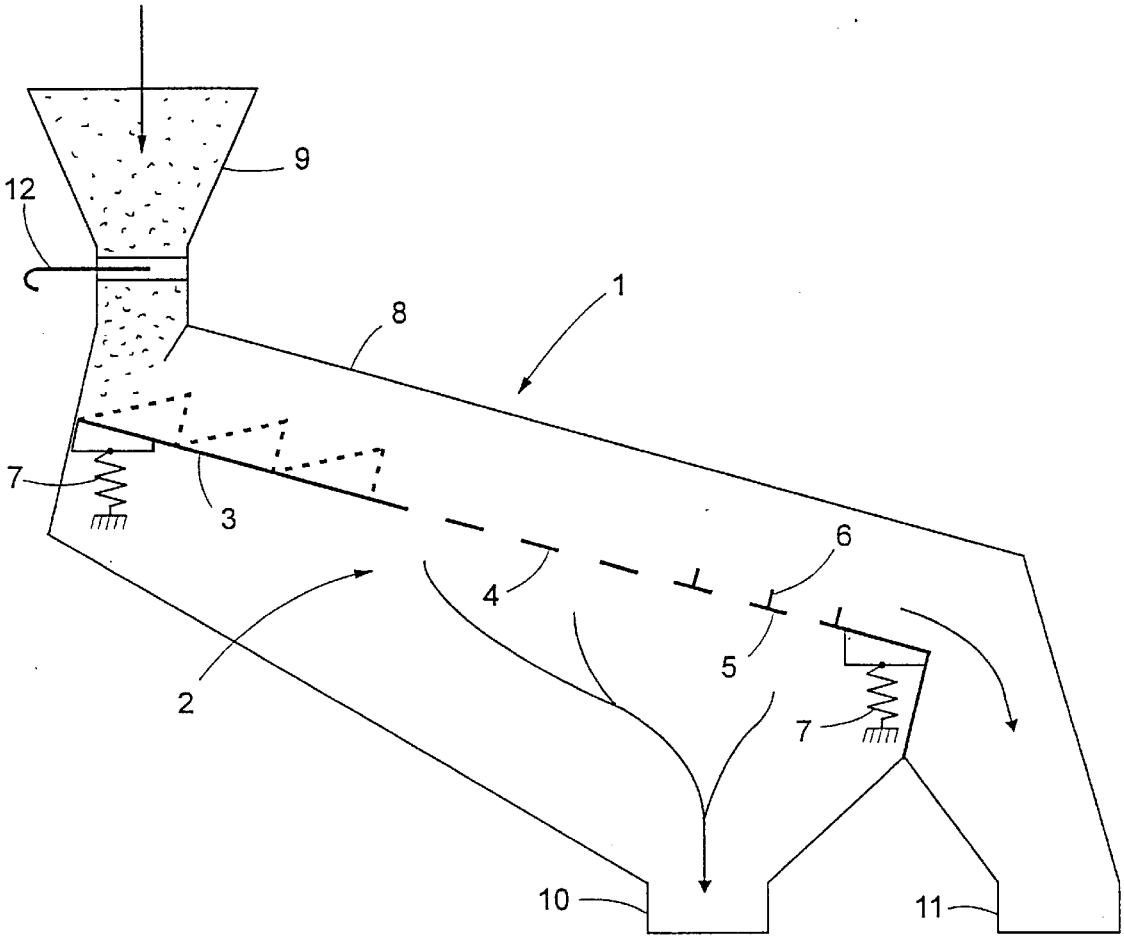
FIG. 1 is a schematic cross-sectional view of a screening apparatus comprising a separator plate according to the invention.

FIG. 1 shows schematically a screening apparatus 1 of a kind that comprises a slanting vibratory screen. The apparatus is generally known per se and the novelty of the apparatus here shown resides in a slanting vibrating separator plate 2 comprising an upstream, non-perforated segment 3, a first downstream screening segment 4 and a second downstream screening segment 5 having a plurality of upwardly protruding pins 6. The upstream, non-perforated segment 3 may be a flat plate as shown in FIG. 1 by way of a continuous line, or it may be corrugated, as shown by way of a dashed line. The separator plate 2 is mounted on a vibrating mechanism 7 driven by a motor (not shown) which causes plate 2 to vibrate both vertically and in its own plane. The apparatus is housed within a casing 8 fitted with a feeder hopper 9 for feeding the bulk particulate material, and with sumps merging into a pair of outlet sleeves 10 and 11 for the discharge of two sorted fractions. The hopper 9 is provided with a gate valve 12 for regulating the flow of the fed-in particulate material. In the particular embodiment of the apparatus here shown, the sorting plate is designed for the delivery of two sorted fractions only and the first and the second screening segments 4 and 5 have equally sized and oriented orifices. Thus a fraction of relatively small size particles is admitted across the orifices of the segments 4 and 5 to be discharged via sleeve 10, and the larger particles are retained on a separator plate 2 and are discharged via sleeve 11.

Figure 2:
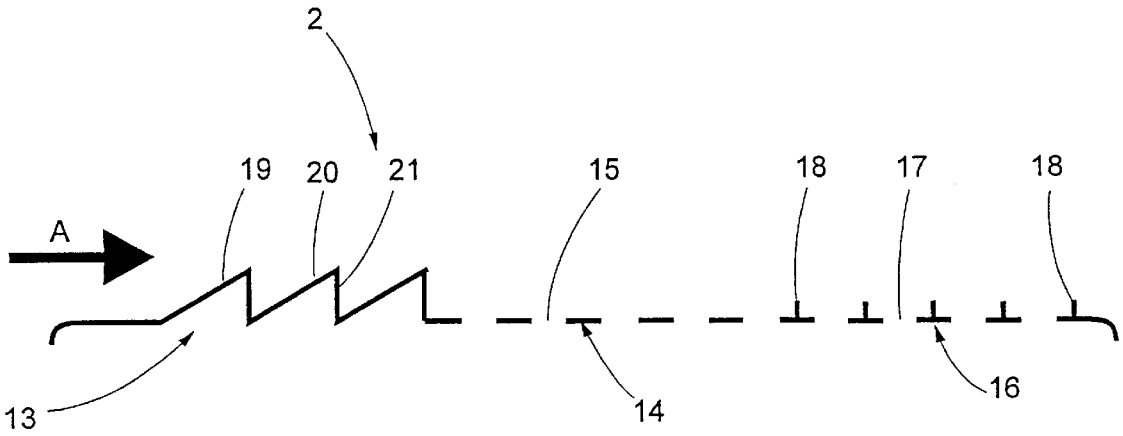
FIG. 2 is a schematic longitudinal cross-section of one embodiment of a separator plate according to the invention.

Attention is now directed to FIG. 2 which is a schematic longitudinal cross-section of a separator plate 2 according to the invention, serving as vibratory screen in the apparatus of FIG. 1. In operation, the bulk particulate material moves by gravity from the left-hand side upstream end to the right-hand side downstream end of separator plate 2.

As shown in this particular drawing, the separator plate 2 comprises a non-perforated corrugated upstream segment 13, a first downstream screening segment 14 with orifices 15 and a second down stream screening segment 16 with orifices 17. The second downstream segment 16 also comprises a plurality of upwardly protruding pins 18.

Figure 3A:
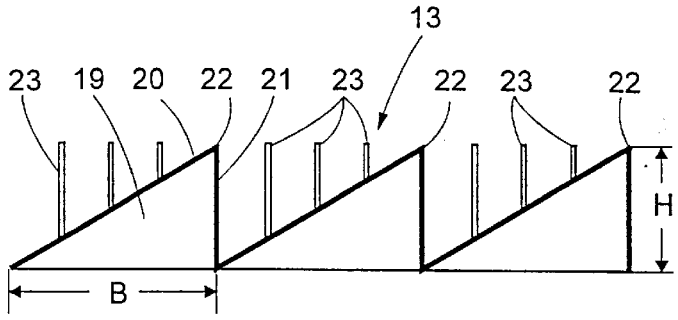
FIG. 3*a* is a schematic longitudinal cross-section of one embodiment of the upstream segment of the separator plate of FIG. 1, drawn to a larger scale.
Figure 4A:
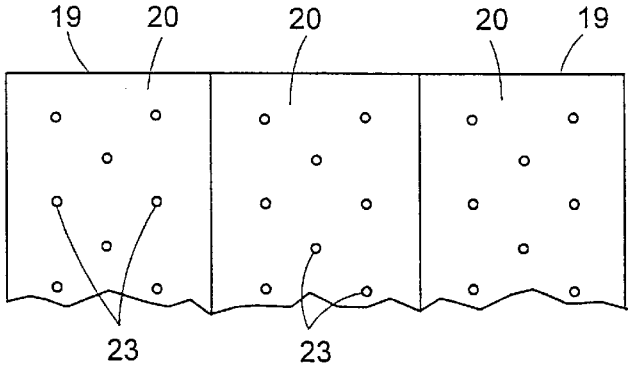
FIG. 4*a* is a schematic plan view of the corrugated upstream segment of FIG. 3*a;*

As also shown in FIGS. 3*a* and 4*a*, the corrugated upstream segment 13 comprises transversal ribs 19 each of which has a relatively gently sloping upstream side 20 and a steep downstream side 21 with all ridges 22 of ribs 19 being coplanar. It is further seen that each of the upstream sides 20 of ribs 19 is fitted with a plurality of upward projecting spikes 23 whose upper ends are coplanar with ridges 22. Preferably the width B of the notional base of each rib 19 is 1.5–2.0 times greater than the height H thereof. Where the orifices of the downstream segments are circular, the height H of the ribs 19 in the upstream corrugated segment 13 are preferably equal to about 8–15 diameters of the orifices.

Figure 3B:
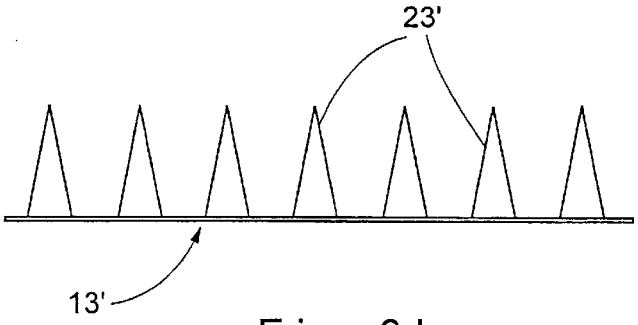
FIG. 3*b* is a schematic longitudinal cross-section of another embodiment of the upstream segment of the separator plate of FIG. 1, drawn to a larger scale.
Figure 4B:
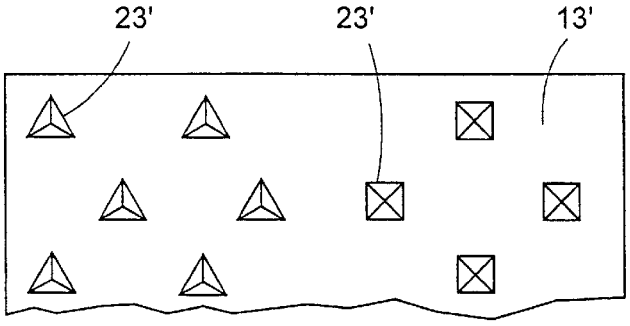
FIG. 4*b* is a schematic plan view of the non-corrugated upstream segment of FIG. 3*b;*

Further, FIGS. 3*b* and 4*b* illustrate the smooth upstream segment 13' fitted with a plurality of upward projecting spikes 23'. Both the spikes 23 in FIGS. 3*a*, 4*a* and spikes 23' in FIGS. 3*b*, 4*b* are intended for enhancing stratification of the bulk material and comminution of clods, which usually appear when the material is damp.

Figure 5:
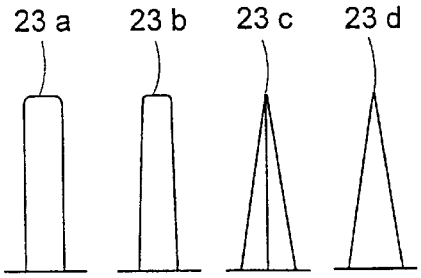
FIG. 5 is an elevation of four embodiments of spikes forming part of the upstream segments of FIGS. 3*a* to 4*b;*

FIG. 5 shows four typical embodiments of spikes 23, namely a cylindrical spike 23*a*, a frusto-conical spike 23*b* and pyramidal spikes 23*c* and 23*d*. The pins 18 may assume similar forms.

Figure 6:
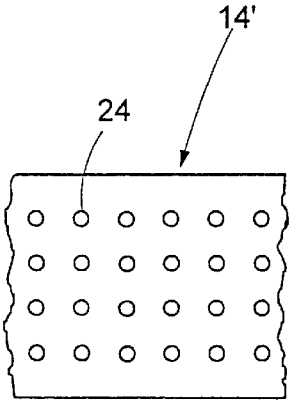
FIG. 6, 7, and 8 are schematic plan views of three different embodiments of a first downstream screening segment in the separator plate of FIG. 2.
Figure 7:
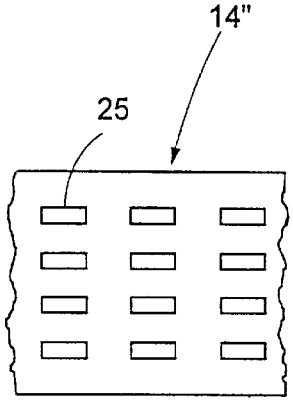
Figure 8:
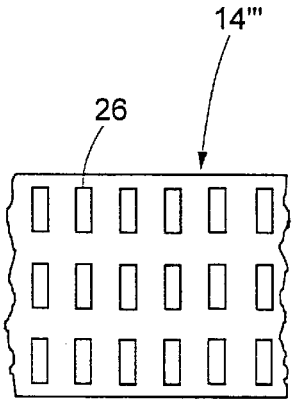

FIGS. 6, 7 and 8 show three alternative embodiments of the first downstream screening segment 14 in FIG. 2 designated here, respectively 14', 14' and 14'''. As shown, in the embodiment of FIG. 6 the orifices 24 are circular, in that of FIG. 7 the orifices 25 are in a form of rectangular slots extending in the direction of flow and in the embodiment of FIG. 8 the orifices 26 are in form of transversal rectangular slots.

Figure 9:
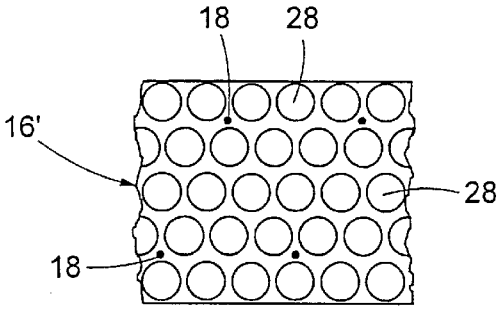
FIGS. 9 and 10 are schematic plan views of two different embodiments of a second downstream screening segment in a separator plate of FIG. 2.
Figure 10:
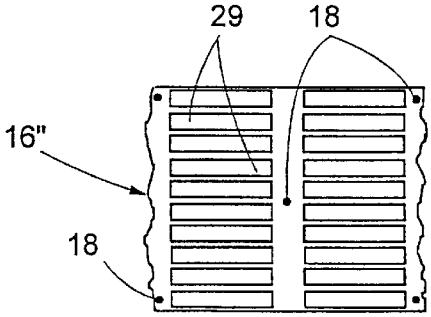

Turning now to FIGS. 9 and 10, there are shown two embodiments of the second downstream screening segment 16 in FIG. 2, designated here 16', 16'', respectively. In the embodiment of FIG. 9 the orifices 28 (17 in FIG. 2) are circular and about twice the size of orifices 24 in the embodiment of the first downstream screening segment of FIG. 6; and in the embodiment of FIG. 10 the orifices are in form of elongated slots 29. As shown, in both the embodiments of FIGS. 9 and 10 the number of the pins 18 is significantly smaller than that of, respectively, orifices 28 and 29.

In operation, the bulk material is fed on to vibrating (and usually slanting) separator plate at the upstream end thereof. Thus, in the case of the separator plate of FIG. 2, the poured-on particulate bulk material first travels along the corrugated upstream segment 13 where it undergoes stratification into layers holding particles of different sizes and densities. During the progress of the bulk material along the upstream corrugated segment 13, the mass of particles climbs along the upstream side 20 of each rib 19 and upon reaching a ridge 22 it drops along the steep, downstream side 21 on to the next following rib 19, and it has been found in accordance with the present invention that in this way a desired stratification in which the smaller and denser particles are underneath and the larger, less denser particles are on top, is readily achieved.

From the upstream corrugated segment 13 the stratified bulk material travels along the first downstream screening segment 14 where a fraction of small size particles is admitted across the screen, a second fraction of larger particles being admitted in the second downstream screening segment 16 while a third fraction of still larger, fast, or wrongly oriented particles is retained by and discharged from the delivery end of the second downstream screening portion 16 of the separator plate 2. The sorting in the second downstream screening segment 16 is enhanced by the pins 18 by reducing the velocity of the particles and orientation thereof with respect to the orifices 17, as explained hereinbefore.

It should be noted that within the general teachings of the present invention many variations are possible. Thus, the upstream segment may be non-corrugated or corrugated, fitted with spikes or not, the shape and number of the transversal ribs in the corrugated upstream segment may be varied according to specific needs and likewise, the size, shape and orientation of the orifices or slots in the downstream screening segments may be varied according to requirements. Also, it is possible to have only one single downstream screening segment or, alternatively, to have more than two such segments.

We claim:

1. A separator plate for the screening of particulate material comprising two or more screening segments with orifices extending therethrough, the screening segments being aligned in a downstream direction; at least one first segment being fitted with a plurality of upward protruding pins distributed between the orifices, and at least one second segment without upward protruding pins; the number of said upward protruding pins on said first segment being small relative to the number of the orifices thereof, whereby the flow velocity of said particulate material on said first segment is reduced and the time of separation is increased.

2. A sorting apparatus according to claim 1, further provided with a non-perforated upstream segment.

3. A separator plate according to claim 2, wherein said non-perforated upstream segment has transversely extending corrugations.

4. A separator plate according to claim 3, wherein said upstream corrugated segment comprises a plurality of transversal ribs each having a relatively gently sloping upstream side and a steep downstream side.

5. A separator plate according to claim 4, wherein the upstream side of each of the ribs is fitted with a plurality of upwards projecting spikes.

6. A separator plate according to claim 2, wherein said non-perforated upstream segment has a substantially smooth upper surface.

7. A separator plate according to claim 6, wherein said substantially smooth upper surface of the upstream non-perforated segment is fitted with a plurality of upwards projecting spikes.

8. A separator plate according to claim 2, wherein said upstream non-perforated segment is fitted with a plurality of upwards projecting spikes.

9. A separator place according to claim 2, wherein said non-perforated upstream segment is followed by said second segment.

10. A separator plate according to claim 1, in which the orifices of different screening segments differ from each other by any of size, shape and orientation.

11. A separator plate according to claim 1, being in form of a single integral body.

12. A separator plate according to claim 1, wherein each of said segments is a separate unit, with sequential units being suitably connected to each other in a rigid fashion.

13. In a sorting apparatus comprising a vibratory screen adapted to vibrate whereby particles of a size smaller than openings in the said screen pass therethrough to obtain classification of the particles, and supporting structure for said vibratory screen, the improvement wherein said vibratory screen is a separator plate according to claim 1.

14. A sorting apparatus according to claim 1, wherein the first and second segments alternate with each other.

15. A separator plate according to claim 1, wherein said pins are shaped as cylinders having a base diameter significantly smaller than their height.

16. A separator plate according to claim 1, wherein said pins are pointed at their upper ends.

* * * * *